US007870706B2

(12) United States Patent
Estes

(10) Patent No.: US 7,870,706 B2
(45) Date of Patent: Jan. 18, 2011

(54) METHOD FOR PACKAGING AND CURING MANUFACTURED STONE PRODUCTS

(75) Inventor: Matthew Estes, Gahanna, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 156 days.

(21) Appl. No.: 12/368,629

(22) Filed: Feb. 10, 2009

(65) Prior Publication Data

US 2010/0199607 A1 Aug. 12, 2010

(51) Int. Cl.
*B65B 63/08* (2006.01)

(52) U.S. Cl. ..... 53/400; 53/440; 53/474; 206/322

(58) Field of Classification Search ..... 53/400, 53/440, 445, 474, 475, 122, 127; 206/322; *B65B 27/02, B65B 63/08*

See application file for complete search history.

(56) References Cited

U.S. PATENT DOCUMENTS

| | | | | |
|---|---|---|---|---|
| 2,738,564 | A | 3/1956 | Guinane | |
| 3,063,767 | A * | 11/1962 | Heuer | 206/322 |
| 4,275,029 | A | 6/1981 | Denison | |
| 5,445,492 | A | 8/1995 | Aubertot | |
| 7,240,791 | B2 | 7/2007 | Alpert et al. | |
| 2008/0019617 | A1 * | 1/2008 | Rasquinha et al. | 53/474 |

* cited by examiner

*Primary Examiner*—Stephen F Gerrity
(74) *Attorney, Agent, or Firm*—MacMillan, Sobanski & Todd, LLC

(57) ABSTRACT

A method of packaging and curing manufactured stone can include packaging a plurality of partially cured de-molded manufactured stones in a curing container having airflow apertures therein. The loaded container is then loaded into a drying oven for further curing for a suitable period. After curing in the oven, the curing container is removed and may be shipped to a customer without unpacking and repacking the manufactured stones.

20 Claims, 3 Drawing Sheets

METHOD FOR PACKAGING AND CURING MANUFACTURED STONE PRODUCTS

BACKGROUND

Manufactured or cultured stone products have gained popularity in the housing industry because of their light weight, variety of style options, ease of installation and relatively inexpensive cost. In general, manufactured stones are produced using specialized dyed concrete. The color of the stones may be varied to provide a variety of style options to consumers. During manufacturing, partially cured stone products are removed from molds and stacked into ovens for further curing. More specifically, de-molded stones are loaded onto wooden pallets, the wooden pallets are loaded onto skids, and the skids are loaded into the ovens. After further curing, the stones are then removed from the ovens and pallets, and packaged for shipping. The time and labor necessary to load the stones onto drying racks, unload the stones and package the stones for shipping is costly. Additionally, if the stones are packaged for shipping before being fully cured, condensation may appear on the surface of the stones, thereby affecting the color of the products and creating unsightly staining.

SUMMARY

The present invention is directed to methods for packaging and curing manufactured stone products. In some examples, a plurality of manufactured stones are removed from molds after partial curing and packaged with wicking material in curing containers having airflow apertures therein. The wicking material separates at least the outside surfaces of the manufactured stones, allowing for airflow between the surfaces for proper drying of the stones. In addition to accommodating the manufactured stone products for drying purposes, the containers may also be used to house the stone products for curing and shipping operations.

In accordance with some embodiments, an airflow gap of at least 0.25 inches (approximately 6 mm) is provided for within the container between outside surfaces of the manufactured stone products during the drying operation. During curing, the loaded curing containers are inserted into a drying oven for a predetermined period of time, in order to allow for further curing of the manufactured stone products. Once cured, the curing containers are removed from the drying oven and used to store the manufactured stone. Thereafter, the manufactured stone products can be directly shipped to customers while still in the container, thereby alleviating the need for further unpacking and packing of the manufactured stones.

Additional objects, features and advantages of the present invention will become more readily apparent from the following detailed description.

BRIEF DESCRIPTION OF THE DRAWINGS

A more complete appreciation of the invention and the many embodiments thereof will be readily obtained as the same becomes better understood by reference to the following detailed description when considered in connection with the accompanying drawings, wherein.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims arc approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1:
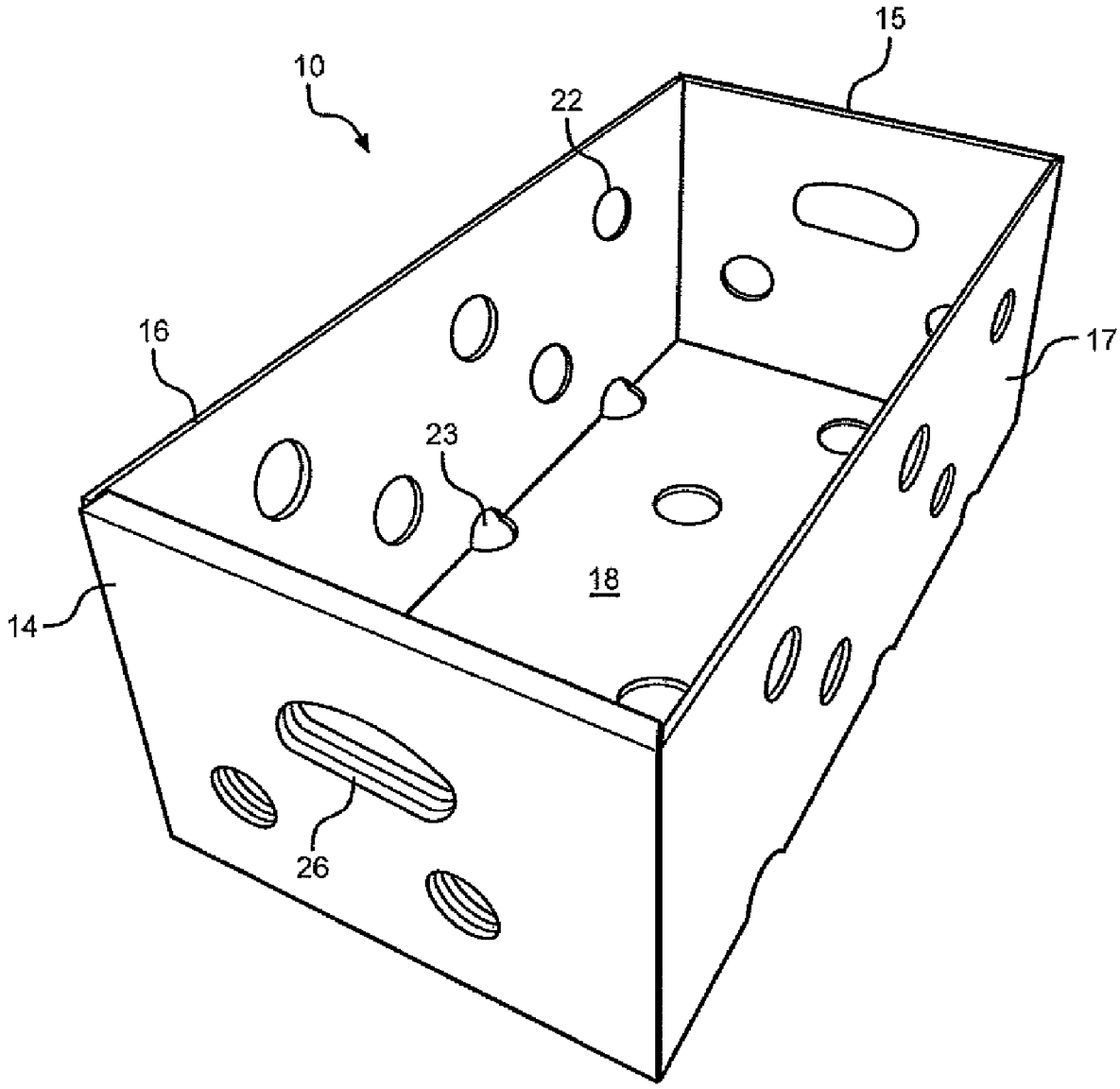
FIG. 1 is a perspective view of a curing container.

With initial reference to FIG. 1, a curing container for use with the packaging and curing method of the present invention is indicated at 10. It will be understood that a any suitable curing container 10 may be used. Curing container 10 includes first, second, third and fourth side walls 14-17 and a bottom wall 18. A suitable number of apertures are provided to facilitate air flow into the curing container 10. For example, each of side walls 14-17 and bottom wall 18 can have a plurality of air flow apertures, such as various side and bottom wall apertures 22. In other examples, various multi-wall or seam apertures 23 may be provided alone or in conjunction with side and bottom wall apertures 22. In yet other examples, air flow apertures may be provided in one of the side walls 14-17 or the bottom wall 18 or in more than one of the side walls 14-17 and/or bottom wall 18. In other examples, container 10 could also include a lid (not shown). If a lid is employed, the lid may also include a plurality of apertures to accommodate the flow of air through container 10. It will be understood that the number and placement of air flow apertures are chosen such that the inflow of air to a bottom of the portion approximately matches an outflow of air from a top portion of the container 10.

Any suitable materials may be used for curing container 10. For example, plastic or metal materials could be used. In other examples, curing container 10 is a corrugated cardboard container. The curing container 10 may have any suitable shape and size. For example, the container 10 may have a capacity of approximately 50 lbs, or 8 square feet. This size permits container 10 to be readily, manually maneuvered. However, larger size containers could be employed, even as large as 400 lb. capacity containers having about 100 sq. ft. of storage space which can be moved with forklift trucks or the like, In some examples, the container 10 has handles 26 to aid in repositioning the container 10. The handles 26 may be provided in any suitable configuration. For example, the handles 26 may be provided along opposing first and second side walls 14 and 15. In some examples, the handles 26 are enlarged through holes, thereby further enhancing the air flow characteristics of container 10. Other suitable types of handles, such as handles that are attached to container 10 may also be used.

Figure 2:
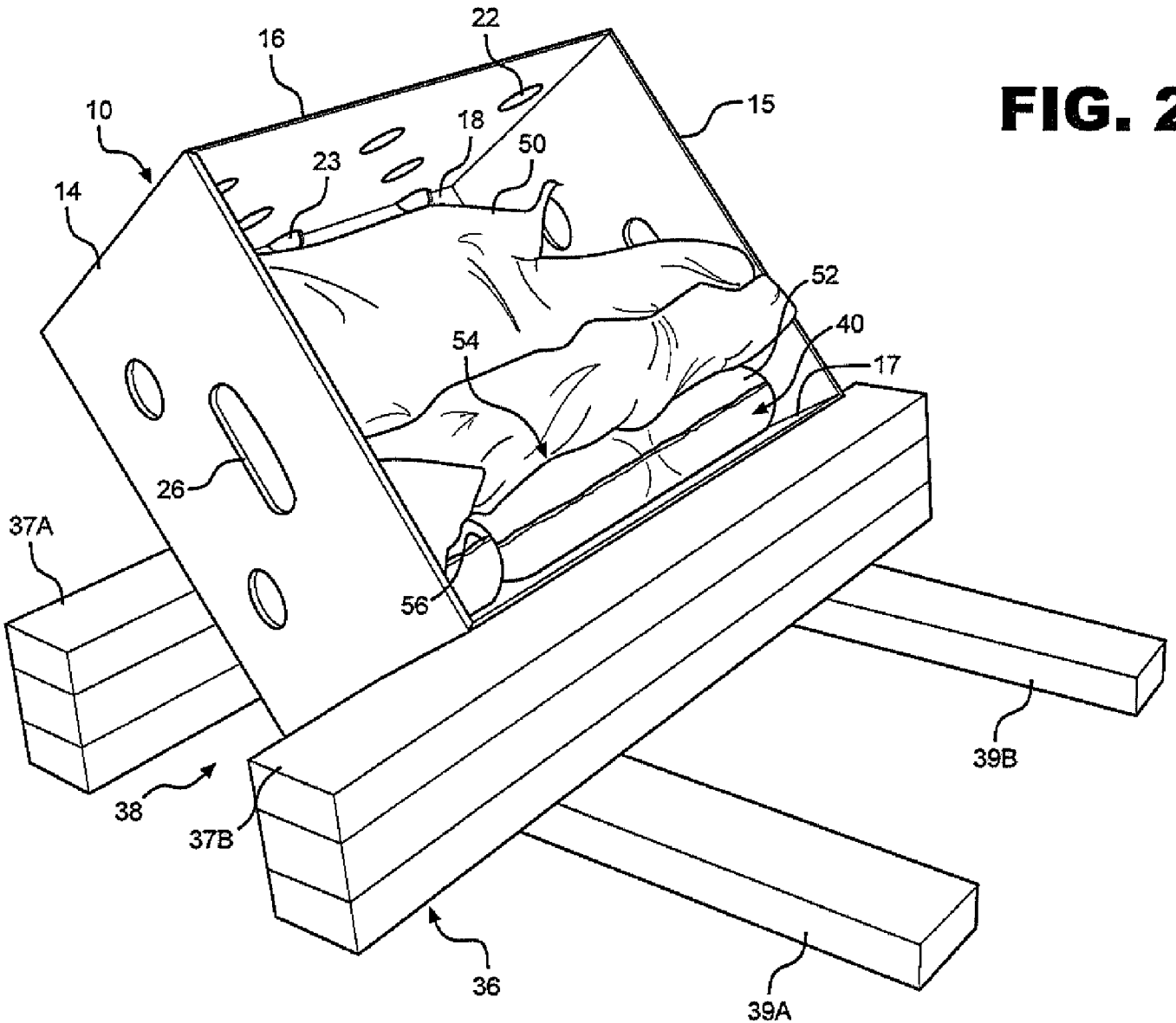
FIG. 2 is a perspective view of the curing container of FIG. 1 including manufactured stone products and being arranged on an angled packaging unit.

Turning to FIG. 2, curing container 10 is shown mounted on an optional angled loading rack 36. In an alternative arrangement, container 10 could be supported on an open belt. When utilized, loading rack 36 enables easier loading of manufactured stones 40 into curing container 10 and prevents overloading or improper loading of curing container 10. In the embodiment shown, loading rack 36 comprises two support stacks 37*a* and 37*b* defining a gap 38 in which curing container 10 may be supported at an angle and two braces 39*a* and 39*b* providing support to stacks 37*a* and 37*b*. Although one suitable loading rack arrangement is depicted, it should be understood that the present invention is not limited by the type of loading rack 36. However, the method of loading container 10 at an angle advantageously allows for efficient stacking and proper spacing of manufactured stones 40. Improper loading of curing container 10 may result in bulging of side walls 14-17, which creates problems when transferring curing containers 10 for drying or shipping.

In some embodiments, a wicking material 50 is utilized for separating outside or exposed surfaces 52 of manufactured stones 40. Any suitable type of wicking material 50 may be used. For example, wicking material 50 may be a polypropylene cloth adapted to wick moisture away from outside or exterior surfaces 52 to enable proper curing of manufactured stones 40. It should be understood that other suitable wicking materials could also be employed, including more expensive but highly functional nylon and polyester materials. In addition to providing the desired wicking function, wicking material 50 of the invention may additionally provide some protection against chips and dings during shipping of manufactured stones 40.

In some embodiments, the manufactured stones 40 are loaded into curing container 10 such that a suitable airflow gap, generally indicated at 54, exists between outside surfaces 52 of the manufactured stones 40. In some examples, airflow gap 54 is at least about 0.25 inches (approximately 6 mm) to assure a proper flow of air between manufactured stones 40 during curing. In some examples, the airflow gap 54 may be provided by the wicking material 50. It should be understood that staining of mounting or back portions 57 of manufactured stones 40 is not as great of a concern as staining of surfaces 52 of stones 40. Therefore, stones 40 may be loaded such that back portions 56 of stones 40 are adjacent one another, as depicted in FIG. 2.

Figure 3:
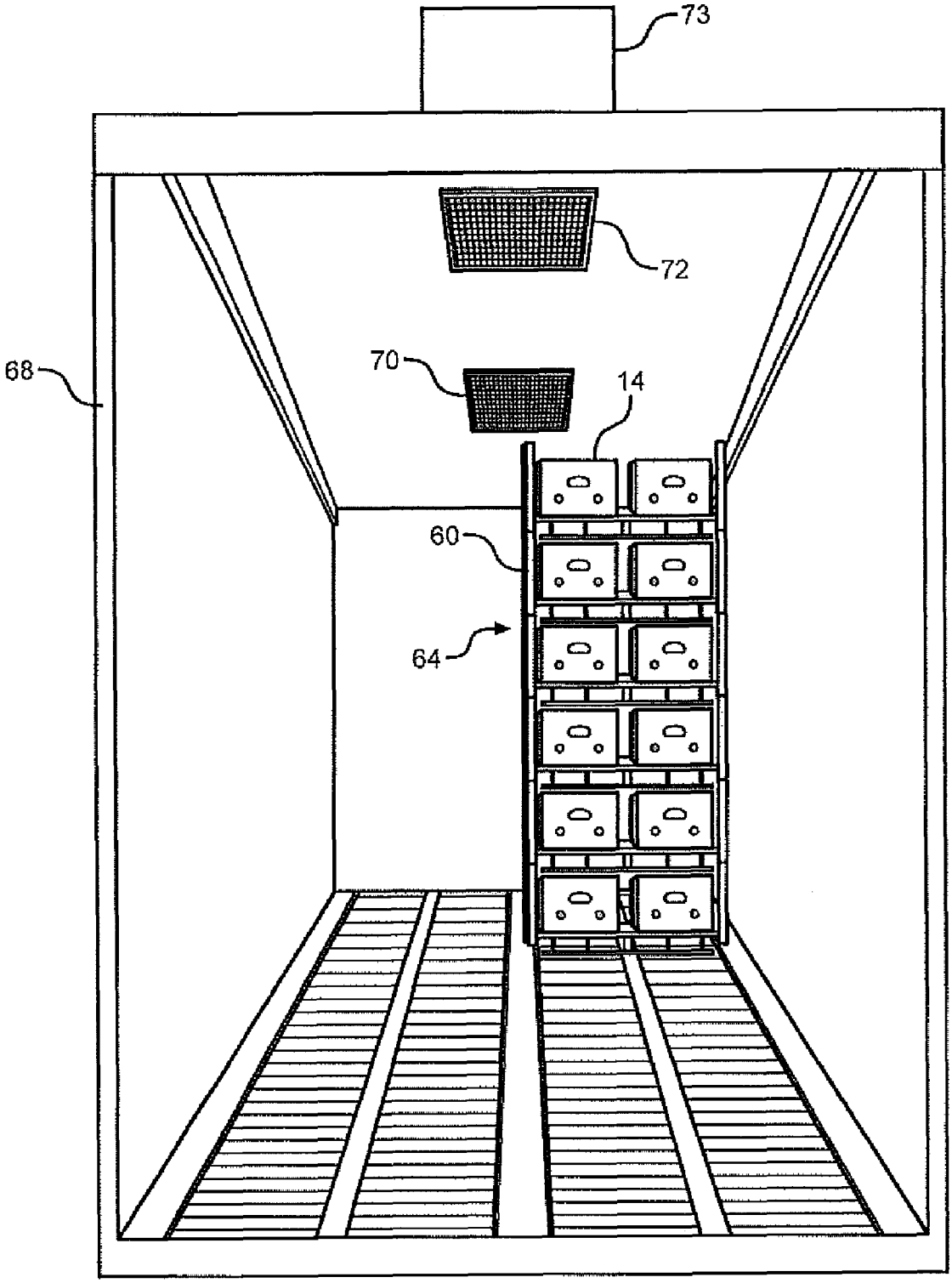
FIG. 3 is a front view of a stack of curing containers within a drying oven for curing the manufactured stone products.

The methods by which manufactured stones 40 are cured will now be more thoroughly discussed with reference to FIGS. 2 and 3. During manufacturing, manufactured stones 40 are created in a mold (not shown) and partially cured for a suitable period. For example, the manufactured stones 40 may be partially cured for a period of approximately 24 hours. The partially cured stones are then de-molded, and loaded into curing containers 10 with wicking material 50 as discussed above. Multiple curing containers 10 (four being shown but with the actual number simply being at least two) are then stacked onto each carrier or pallet 60, and various pallets 60 (six as shown in the exemplary arrangement of FIG. 3) are stacked to make a load 64.

Load 64 is then placed within an oven 68, and the entire load 64, as well as other loads (not shown), is subjected to a drying airflow within oven 68 for a second curing period. The second curing period may be any suitable curing period. For example, the second curing period may be in the range of approximately 18-24 hours. In some examples, during this curing period, a heated air flow within oven 68 circulates through each container 10, such as from a back inlet portion indicated at 70 to a front recirculation portion indicated at 72, and is re-circulated through roof duct 73 incorporating a heater and blower (not shown). After this second curing period, load 64 is removed from oven 68 and stored for later transport, directly placed in a transport vehicle (not shown), or individual pallets 60 may be selectively loaded onto the transport vehicle for shipping to a customer.

Advantageously, time and manpower is reduced by providing a system wherein container 10 can be used for initial drying, further curing, storing and shipping purposes. With this overall arrangement, the present invention also advantageously prevents condensate staining of manufactured stones 40 as manufactured stones 40 continue to cure after removal from drying oven 68. As a result, defective product returns are minimized and customer satisfaction increased.

Although described with reference to a preferred embodiment of the invention, it should be readily understood that various changes and/or modifications can be made to the invention without departing from the spirit thereof. For instance, although rounded stone veneer is depicted, it should be readily understood that the present system could be utilized in conjunction with any type of manufactured stone product, including brick products, requiring an extended curing period.

I claim:

1. A method of packaging and curing manufactured stone comprising:

providing a curing container including, first, second, third, and fourth side walls and a bottom wall, at least one of the side walls and bottom wall including airflow apertures therein;

packaging a plurality of partially cured manufactured stones in the curing container;

positioning a wicking material between outside surfaces of adjacent ones of the partially cured manufactured stones and maintaining an air flow gap between the adjacent ones of the partially cured manufactured stones;

inserting the curing container into a drying oven; and further curing the partially cured manufactured stones in the curing container to produce cured manufactured stones.

2. The method of claim 1, further comprising:

shipping the cured manufactured stones in the curing container without repacking the cured manufactured stones.

3. The method of claim 1, wherein more than one of the side walls and bottom wall includes airflow apertures therein.

4. The method of claim 1, wherein each of the side walls and bottom wall includes airflow apertures therein.

5. The method of claim 1, wherein providing a curing container constitutes providing a corrugated cardboard curing container.

6. The method of claim 1, wherein providing a curing container constitutes providing a curing container having a handle portion located at each of the respective first and second sidewalls.

7. The method of claim 1, wherein packaging the plurality of cured manufactured stones constitutes positioning the curing container on an angled loading rack and then loading the plurality of partially cured manufactured stones in the curing container.

8. The method of claim 7, wherein packaging the plurality of partially cured manufactured stones in the curing container constitutes packing the plurality of partially cured manufactured stones such that the air flow gap between the outside surfaces of the adjacent ones of the partially cured manufactured stones is at least 0.25 inches.

9. The method of claim 8, wherein the wicking material of the packaging step is polypropylene cloth.

10. The method of claim 9, wherein the further curing is conducted for a curing period of approximately 18-24 hours.

11. The method of claim 7, wherein providing a curing container constitutes providing a curing container having a capacity of approximately 50 pounds.

12. The method of claim 7, wherein providing a curing container constitutes providing a curing container having a capacity of approximately 8 square feet.

13. The method of claim 1, wherein packaging the plurality of partially cured manufactured stones in the curing container constitutes packing the plurality of partially cured manufactured stones such that the air flow gap between the outside surfaces of the adjacent ones of the partially cured manufactured stones is at least 0.25 inches.

14. The method of claim 13, further comprising: shipping the cured manufactured stones in the curing container without repacking the cured manufactured stones.

15. The method of claim 1, wherein the wicking material of the packaging step is polypropylene cloth.

16. The method of claim 1, wherein the further curing is conducted for a curing period of approximately 18-24 hours.

17. The method of claim 1, wherein providing a curing container constitutes providing a curing container having a capacity of approximately 50 pounds.

18. The method of claim 1, wherein providing a curing container constitutes providing a curing container having a capacity of approximately 8 square feet.

19. The method of claim 1, wherein at least some of the airflow apertures extend across multiple ones of the side and bottom walls to provide airflow through the container at seam portions of the container.

20. The method of claim 1, wherein the placement of the airflow apertures is chosen such that a flow of air into the bottom of the container approximately matches the flow of air out of the top portion of the container.

* * * * *

UNITED STATES PATENT AND TRADEMARK OFFICE

CERTIFICATE OF CORRECTION

PATENT NO. : 7,870,706 B2
APPLICATION NO. : 12/368629
DATED : January 18, 2011
INVENTOR(S) : Estes It is certified that error appears in the above-identified patent and that said Letters Patent is hereby corrected as shown below:

Column 2
Line 29, "arc" should read -- are --

Signed and Sealed this
Twenty-eighth Day of February, 2012

David J. Kappos

David J. Kappos
*Director of the United States Patent and Trademark Office*